United States Patent [19]

Watford

[11] Patent Number: 5,022,570

[45] Date of Patent: Jun. 11, 1991

[54] COLLAPSIBLE GARMENT HANGER WITH CORRUGATED TUBING

[76] Inventor: Roger L. Watford, 2126 Wilderness Point, Kingwood, Tex. 77339

[21] Appl. No.: 459,462

[22] Filed: Jan. 2, 1990

[51] Int. Cl.[5] ..... A47G 25/40; A47G 25/14

[52] U.S. Cl. ..... 223/94; 223/92; 223/89; 223/88; 223/85

[58] Field of Search ..... 223/85, 86, 88, 89, 223/92, 94; 211/113; D6/315, 317, 318

[56] References Cited

U.S. PATENT DOCUMENTS

| | | | |
|---|---|---|---|
| 1,607,749 | 11/1926 | Rice | 223/88 |
| 2,510,375 | 6/1950 | Brant | 223/89 |
| 3,194,457 | 7/1965 | Freilich | 223/88 |
| 3,409,224 | 11/1968 | Harp et al. | 239/33 |
| 3,430,827 | 3/1969 | Nelson | 223/89 |
| 3,459,348 | 8/1969 | Masson | 223/87 |
| 3,471,069 | 10/1969 | Simon | 223/91 |
| 3,587,949 | 6/1971 | Reller et al. | 223/93 |
| 3,645,426 | 2/1972 | Glascock et al. | 223/89 |
| 3,645,427 | 2/1972 | Dekker | 223/96 |
| 3,790,046 | 2/1974 | Rooney | 223/92 |
| 3,802,610 | 4/1974 | Love et al. | 223/94 |
| 3,802,611 | 4/1975 | Darden | 223/94 |
| 3,834,598 | 9/1975 | Matsumoto | 223/89 |
| 3,908,704 | 9/1975 | Clement | 138/21 |
| 3,923,212 | 12/1975 | Brunner | 223/88 |
| 4,063,670 | 12/1977 | Faarbech | 223/92 |
| 4,479,538 | 10/1984 | Coyle | 166/173 |
| 4,492,313 | 1/1985 | Touzani | 215/1 C |
| 4,579,538 | 4/1986 | Bass et al. | 446/107 |
| 4,813,581 | 3/1989 | LaMont | 223/94 |

*Primary Examiner*—Werner H. Schroeder
*Assistant Examiner*—Bibhu Mohanty

[57] ABSTRACT

A hanger particularly suitable for sweaters and other knit garments which are susceptible to being deformed by conventional hangers. The hanger has a corrugated tube portion. The corrugated tube may be expanded, contracted or axially bent and maintain its new shape without spring-back. Various hook assemblies are provided for use with the hanger which enhance the hanger.

17 Claims, 2 Drawing Sheets

FIG.1
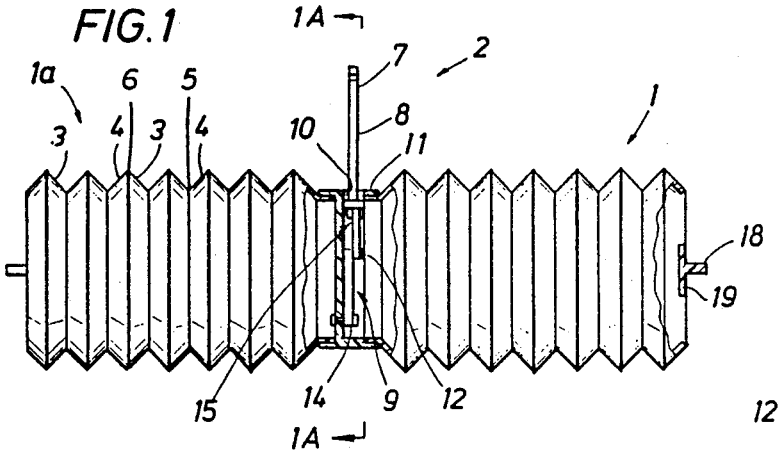
FIG.1A
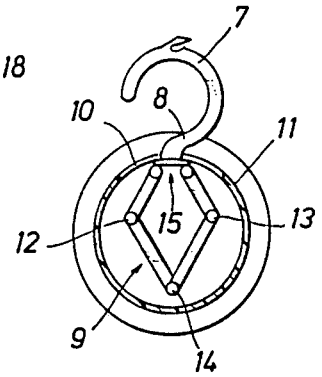
FIG.2
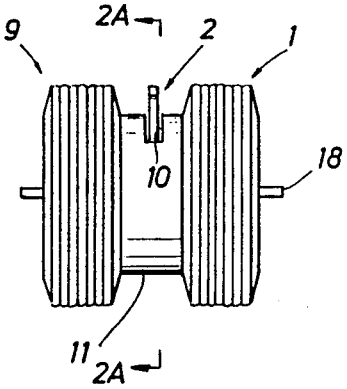
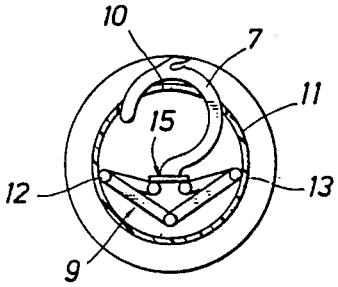
FIG.2A
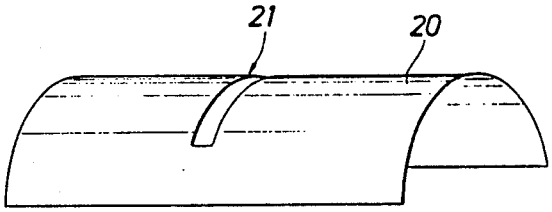
FIG.3
FIG.4
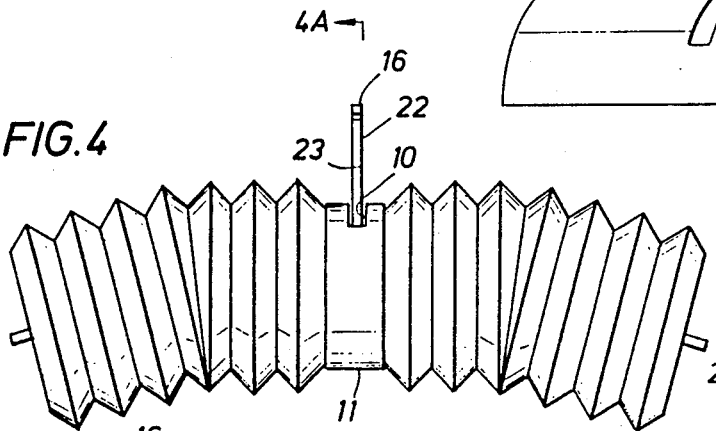
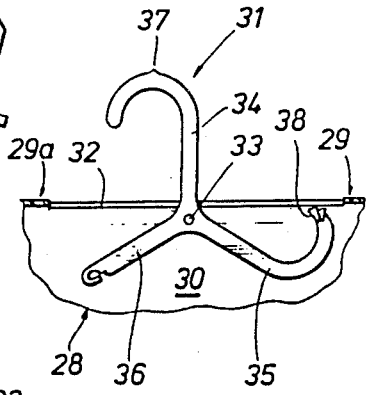
FIG.5
FIG.4A
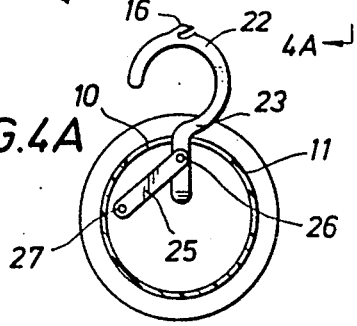
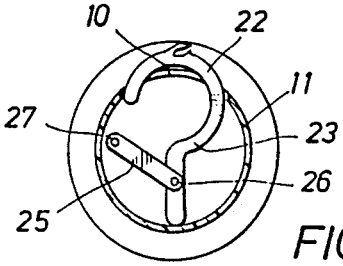
FIG.4B FIG.6
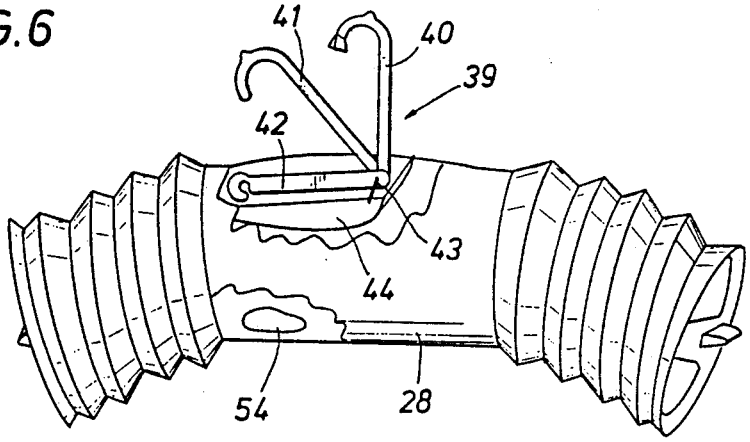
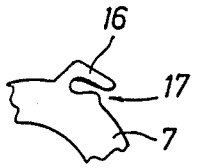
FIG.7
FIG.8
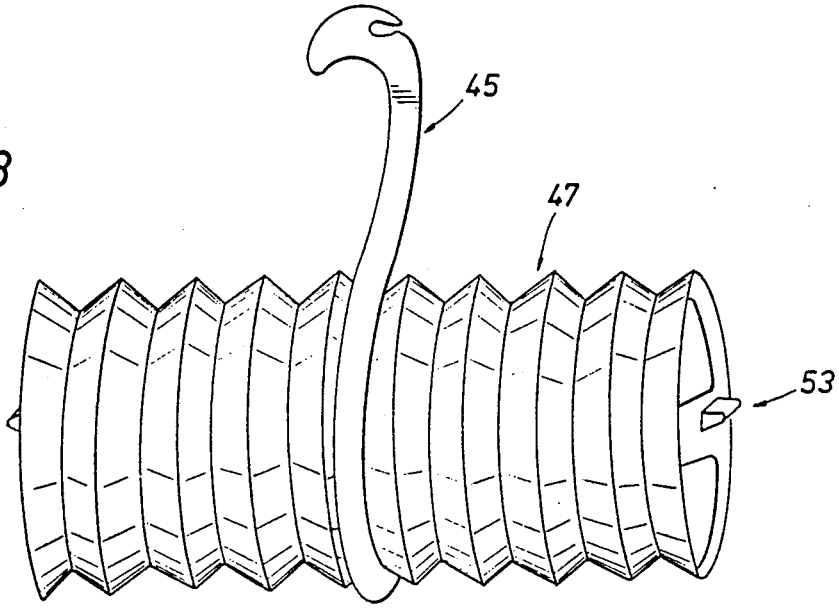
FIG.9
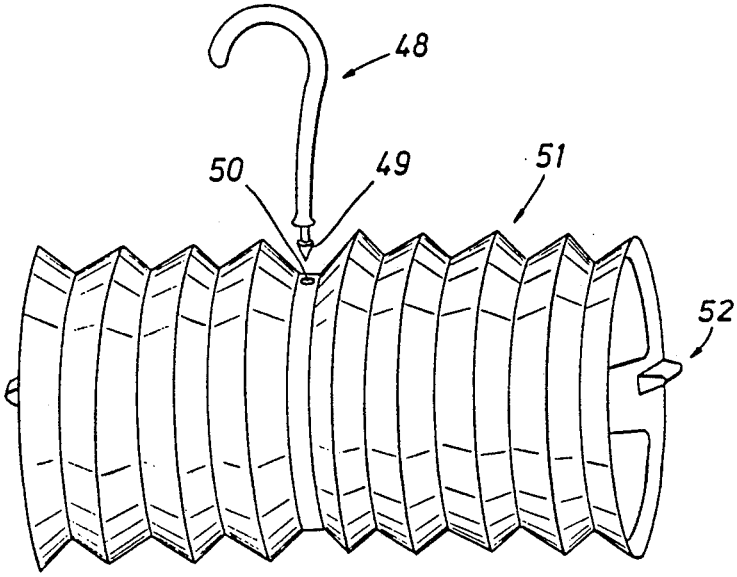

COLLAPSIBLE GARMENT HANGER WITH CORRUGATED TUBING

BACKGROUND OF THE INVENTION

1. FIELD OF INVENTION

The present invention pertains to hangers and more specifically to a hanger having corrugated arms which are readily extended and retractable which can be bent to assume a desired configuration which is maintainable without spring-back.

2. DESCRIPTION OF PRIOR ART

A well known difficulty with standard hangers is the imprint such hangers make in certain clothing, particularly sweaters. Thus, such hangers stretch sweaters and other knit items, out of shape and leave a crease at the top of the shoulders.

Another difficulty with standard hangers is that such hangers generally are not adaptable to different shapes of garments. Thus, one size hanger may be required to fit multiple sizes of garments. In addition, the general configuration of the hanger may be a problem, i.e. the hanger may have sharply sloping arms, whereas the garment may have relatively squared-off shoulders. Such misfitting hangers can eventually cause garments to permanently lose their shapes and thus no longer look well-tailored on the wearer of the garment. Yet another difficulty with standard hangers is in the hook assembly. This difficulty takes several forms, i.e., (1) the hook may not hang with any stability from a flat surface, such as the edge of a ledge, (2) the hook may not fit a relatively small diameter line such as a clothes line, and (3) the hook may cause damage or injury during the hanging of a sweater or other knit garment by becoming entangled therewith.

An addition difficulty with standard hangers resides in their size and awkwardness. They are not easy to transport because of their inflexibility, and they may become entangled and damage the other contents of a suitcase, etc.

The present invention overcomes the above and other problems of the art as will become apparent from the following description thereof.

SUMMARY OF THE INVENTION

The primary purpose of the present invention is to provide a garment hanger which is axially flexible and length adjustable in order to overcome the above described problems of the art. In addition, the hanger may have a retractable hook assembly to avoid the other above-mentioned problems of the art.

Accordingly, the present invention is directed to a garment hanger having at least one integrally formed tubular element and a hook for hanging the tubular element from a support. The tubular element includes a plurality of connected corrugations formed by alternating first and second circumferential walls joined together base to base about circumferentially extended hinges, the first walls being shorter than the second walls such that the first walls are nestable within the second walls. Preferably, the walls are truncated conical shaped, the base-connecting hinges are convex and the apex-connecting hinges are concave.

The present invention includes a variety of hook assemblies having various features, and which may be employed with the tubular element described supra, or with conventional hangers, or with non-conventional hangers functioning with purpose similar to the present invention. A first hook assembly utilizes a hook attached to a scissors extension element being functional to extend and retract the hook in relation to the hanger. A second hook assembly has at least two integral hooks rotatable about a common pivot point on a hanger, the rotation being functional to extend one hook while retracting another hook in relation to the hanger. A third hook assembly has at least two hooks separately hinged about a common pivot point on a hanger, each hook being functional to rotate about the pivot and thereby extend and retract in relation to the hanger. A fourth hook assembly has a hook hinged at one end to a leg element which in turn is hinged at an opposite end to a garment hanger, the hook being functional to extend and retract in relation to the hanger. A fifth hook assembly has an arcuate element integral with a leg element, the leg element being connectable, at an end opposite to the arcuate element, to a garment hanger, and the arcuate element having, at an end opposite to the leg element, a pivotable tip assembly functional to hang the hook from a relatively flat surface. A sixth hook assembly has an arcuate element integral with a leg element, the leg element being connectable, at an end opposite to the arcuate element, to a garment hanger, and the arcuate element having, at an end opposite to the leg element, an opening sufficiently wide to admit thereinto a relatively small diameter line suitable for hanging garments therefrom, the narrow opening being progressively more narrow for a relatively short distance and then becoming progressively wider as the opening defines the inside curvature of the arcuate element. For the latter hook assembly, the arcuate element may be indirectly integral with the leg element by being integral with a second arcuate element which in turn is integral with the leg element, the second arcuate element being relatively larger than than the first arcuate element. Seventh and eighth hook assemblies are not retractable but engage the tubular element differently from the first through sixth hook assemblies. The seventh hook assembly has one end which snugly and supportingly nestles between the corrugations of the corrugated element, and the eighth hook assembly "snap-on" the corrugated element, preferably by insertion of a pointed end of the hook assembly into an orifice of the tubular element.

Other advantages, features and benefits of the invention will be manifest from the following more detailed description thereof given in reference to the drawings.

DESCRIPTION OF THE DRAWINGS

FIGS. 1, 1A, 2 and 2A show a garment hanger with a scissors extension element.

FIG. 3 depicts a cover for the hangers.

FIGS. 4, 4A, 4B, 5 and 6 show other embodiments with different extension mechanisms for retractable hooks.

FIG. 7 is a segment of the arcuate element shown in FIG. 1.

FIGS. 8 and 9 show hook assemblies which are not retractable.

DESCRIPTION OF PREFERRED EMBODIMENTS

Referring now to the drawings in detail, there is illustrated a preferred form of a length adjustable, axially flexible hanger constructed in accordance with the principles of the invention and which includes in its most general form a corrugated tubular element 1 and a hook assembly 2. FIG. 1 shows the hanger in its expanded form, while FIG. 2 shows the hanger in its contracted form. As a general rule of thumb, the ratio of the expanded form to the contracted form may be on the order of 4 to 1.

The tubular element 1 is composed of a plurality of corrugations which include, in a most preferred form, a truncated conical wall 3 and a second truncated conical wall 4. The conical walls 3 and 4 are joined together apex to apex and base to base to form the corrugations. Where the base of wall 3 joins the base of wall 4, there is a convex circumferentially extending hinge 5. Hinge 5 permits walls 3 and 4 to flex with respect to one another. Where the walls 3 and 4 join apex to apex, there is a circumferentially extending concave hinge 6. Hinge 6 additionally permits walls 3 and 4 to flex with respect to one another. The entire corrugated tubular element 1 is formed integrally of a series of walls 3 and 4 corresponding hinges of a plastic material known to the art. One of the walls, such as wall 3, is slightly shorter than the other wall, such as wall 4, and each shorter wall is nestable within each adjacent longer wall when the tubular element 1 is folded. This feature of "nesting" of the walls allows the tubular element 1 to be folded or expanded and retain its shape without "spring-back". It also allows the tubular element 1 to be axially flexible and assume different shapes, without spring-back, as shown in FIGS. 4 through 6. The hinges 5 and 6 of tubular element 1 may be rounded or sharply convergent as shown, or take other shapes. Also, the tubular element need not be round, as shown, but can be other shapes, i.e. oval. U.S. Pat. Nos. 3,908,704 and 4,579,538 are herewith incorporated hereinto by reference thereto.

Referring now to other features of the preferred embodiment of the hanger as shown in FIGS. 1 and 2, it may be seen that the hook assembly 2 has a unique construction. The hook assembly is composed of an arcuate element 7 connected via a leg element 8 to a scissors extension element 9 functional to extend and retract the hook assembly 2 through opening 10 of tubular element 11. Tubular element 11 may be integral with or fit between tubular elements 1 and 1A. The three tubular elements 1, 1A, and 11 may be attached with adhesive, etc. Scissors extension element 9 is shown in its contracted form in FIG. 2. The extension element 9 includes two hinges 12 and 13 and fastener 14 which anchors element 9 to a wall of tubular element 11. Leg element 8 of hook assembly 2 is attached to scissors extension element 9 by base member 15.

Integral with arcuate element 7 is a relatively smaller arcuate element 16 as better shown in the detail FIG. 7. The latter arcuate element has an opening 17 sufficiently wide to admit thereinto a relatively small diameter line, such as a clothes line, the narrow opening 17 becoming progressively more narrow for a rlatively short distance and then becoming progressively wider as the opening defines the inside curvature of the arcuate element 16.

The ends of the tubular element 1 and 1A are preferably provided with a tab 18 supported by a framework 19. Tab 18 is suitable for grasping the tubular element 1 and 1A in order to open or close the corrugations of element 1 and 1A. Tab 18, while convenient, is not necessary to utilization of the invention.

FIG. 3 discloses a cover 20 which fits over the top of corrugated elements FIGS. 1 through 9. Opening 21 permits extension of a hook assembly therethrough. Cover 20 is designed to eliminate the effects of the tubular corrugations on a garment, where this is desired. Cover 20 may of course completely enclose the corrugated tubular element and may be folded and unfolded with the expanding and contracting of tubular elements. By and large, cover 20 may be desirable, although not essential to the invention.

FIG. 4 provides yet another type of hook assembly which is useful in the invention. This hook assembly is used with the same tubular element 11 as the embodiment of FIG. 1. First arcuate element 17, integral leg 23 and second arcuate element 16 comprises a hook which is hinged to leg element 25 by hinge 26, the latter leg element in turn being hinged by hinge 27 to a wall of tubular element 11. The hook assembly thus formed is functional to retract into and extend out of tubular element 11 with relative ease.

A relatively different type of hook assembly is shown in FIG. 5. Tubular element 28 is relatively longer than the tubular element 11 shown in FIG. 1 through 4. Element 28 may be integral with tubular elements 29 and 29A or may be a separate element to which tubular elements 29 and 29A are attached, e.g. with adhesive. In either case, a wall or support 30 is provided which supports a spinning hook assembly 31 which extends through opening 32 and which rotates about pivot 33. Alternatively, hook assembly 31 may be hinged at the opening 32 so that wall 30 is not required. Rotation of hook assembly 31 is functional to extend one of hooks 34 through 36 while retaining the other two hooks inside tubular element 28. Hook 34 is standard with the exception of tab 37 which is utilized to grasp the hook for rotating it out of tubular element 28. This same feature may be seen on a number of other hooks shown in the drawings. Hook 36 is similar to arcuate element 16 shown in FIG. 7 but does not have a relatively larger arcuate element such as element 7 shown in FIGS. 1 and 7. Hook 35 is unique in its provision of a pivotable tip assembly 38 which is functional to hang the hook from a relatively flat surface such as the horizontal edge of a ledge, i.e. the tip assembly furnishes the sole hanging support for the hook. Thus, hangers are frequently hung, although awkwardly, from the edge of molding around a doorway. Tip assembly 38 makes this type of ussage more stable for the hook, and can be employed with most of the hooks shown.

FIG. 6 provides yet another type of hook assembly useful with the invention. This figure, and FIG. 5, also demonstrate the axial flexibility of the hanger of this invention. Hook assembly 39 provides three hooks 40 through 42, of designs shown in the previous figures, which are separately hinged about a common pivot point or axle 43. When not in use, one or all of hooks 40 through 42 rest in container 44. FIG. 6 also shows a scent in element 54 known to the art (e.g. moth balls or potpourri) which can be used in hangers 1 through 9 to provide a scent of choice to garments if desired.

FIG. 8 discloses a non-attached "S-shaped" hook assembly 45 which has hooks at both ends each of which functions dually, i.e. to grasp corrugated element 47 and to grasp another element such as a clothes line. The arcuate shape of both hooks of hook assembly 45 preferably are of such dimensions as to snugly nestle between the corrugations or corrugated element 47 without actually being attached to the corrugated element. Such a hook assembly might also be shaped in other forms than a "S-shape", e.g. a "C-shape". When this hanger is not in use, the hook assembly may be stored inside member 47, which may be either expanded or collapsed. This feature also facilitates packaging.

FIG. 9 shows a "snap-on" type of hook assembly 48, which has a pointed member 49 which is inserted into orifice 50 the pointed member having a slightly larger diameter than the diameter of the orifice, whereby a locking engagement is formed between the hook and the corrugated element 51. As in the embodiment of FIG. 7, this hook assembly 48 may likewise be stored inside the corrugated member 51. For this feature to be operative, of course the end assembly 52 would need to be removable, openable or non-existant, which is also true of end assembly 53 shown in FIG. 8. Other types of "snap-on"hooks may be used, i.e. a hook assembly having legs which encircles the corrugated member and back together.

In view of the above-described invention and disclosure, variations and modifications to meet individual whim or particular need will doubtless become evident to others skilled in the art to obtain all or part of the benefits of the invention without copying the specific structures shown, and hence such variations and modifications are claimed insofar as they fall within the spirit and scope of the following claims.

Having thus described the invention, what is claimed as new and what is desired to secure by Letters Patent is:

1. A garment hanger comprising:

at least one integrally formed tubular element and a hook for hanging the tubular element from a support, said tubular element including a plurality of connected corrugations formed by alternating first and second circumferential walls joined together base to base about circumferentially extending hinges and apex to apex about circumferentially extending hinges, said tubular element being at least partially collapsible, whereby at least two walls of the tubular element are side by side.

2. The garment hanger of claim 1 wherein the walls are truncated conical shaped, said first walls being shorter than said second walls such that they are nestable within said second walls.

3. The garment hanger of claim 1 wherein the tubular element comprises two pieces connected by a third tubular element housing said hook.

4. The garment hanger of claim 1 including at least one sleeve covering the corrugations.

5. The garment hanger of claim 1 including means for grasping the ends of the tubular element.

6. The garment hanger of claim 3 wherein said hook is attached to a scissors extension element operable to extend and retract the hook out of and into the third tubular element.

7. The garment hanger of claim 3 wherein said hook comprises one of at least two integral hooks rotatable about a common pivot, the rotation being functional to extend one hook while retracting another hook out of and into the third tubular element.

8. The garment hanger of claim 3 wherein said hook comprises one of at least two hooks hinged about a common pivot, each hook being adjustable to extend out of and to retract into the third tubular element.

9. The garment hanger of claim 3 wherein said hook is hinged at one end to a leg element which in turn is hinged at an opposite end to the garment hanger, the hook being extendable and retractable in relation to the hanger.

10. The garment hanger of claim 1 wherein said hook has a pivotable tip assembly.

11. The garment hanger of claim 1 wherein said hook includes a small diameter line grasping element.

12. The hanger of claim 1 wherein said hook is pivotable.

13. The hanger of claim 1 wherein said hook is snapable onto the tubular element.

14. The hanger of claim 13 wherein said hook has a pointed member insertable into an orifice in said tubular element, the pointed member having slightly larger diameter than the orifice the oversizing providing locking engagement between the hook and the tubular element.

15. The hanger of claim 1 wherein said hook, at one end, encircles the exterior of the tubular element without being attached to the tubular element.

16. The hanger of claim 15 wherein said hook is "s-shaped" with a hook being located at both ends of the "s-shape", whereby one end of said hook is functional to support the tubular element and the other end of said hook is functional to engage means for supporting the hanger.

17. The garment hanger of claim 1 including a scented element insert into the tubular element for scenting of garments.

* * * * *